US005098066A

United States Patent [19]

Willcox, III

[11] Patent Number: 5,098,066

[45] Date of Patent: Mar. 24, 1992

[54] CLAMP FOR HANGING JACK

[75] Inventor: Frederick E. Willcox, III, Houston, Tex.

[73] Assignee: Perma Pile Foundation Restoration Systems, Inc., Houston, Tex.

[21] Appl. No.: 642,826

[22] Filed: Jan. 18, 1991

[51] Int. Cl.[5] ..... B66F 3/00

[52] U.S. Cl. ..... 254/134; 254/DIG. 4

[58] Field of Search ..... 254/133 R, 134, DIG. 4, 254/DIG. 16; 269/17, 95, 105, 155, 246

[56] References Cited

U.S. PATENT DOCUMENTS

| | | | |
|---|---|---|---|
| 222,588 | 12/1879 | Hogeland | 254/134 |
| 1,264,261 | 4/1918 | Balnkenship . | |
| 1,483,004 | 2/1924 | MacDow . | |
| 1,823,204 | 9/1931 | Long | 269/17 |
| 1,933,116 | 10/1933 | Jones | 248/2 |
| 2,612,355 | 9/1952 | Thompson | 254/134 |
| 2,687,874 | 8/1954 | Newman | 254/134 |
| 2,776,495 | 1/1957 | Dickey | 33/207 |
| 2,839,100 | 6/1958 | Valicenti | 7/164 |
| 2,908,403 | 10/1959 | Browder, Jr. et al. | 269/17 |
| 3,183,581 | 5/1965 | Lister | 29/200 |
| 3,371,902 | 3/1968 | Hartwick | 248/354 |
| 3,858,864 | 1/1975 | Waldow | 269/17 |
| 4,634,319 | 1/1987 | May | 405/230 |
| 4,659,072 | 4/1987 | De La Rosa | 269/17 |
| 4,765,777 | 8/1988 | Gregory | 405/230 |

*Primary Examiner*—J. J. Hartman

*Attorney, Agent, or Firm*—Vaden, Eickenroht, Thompson & Boulware

[57] ABSTRACT

A hanging jack clamp for hanging a jack upside down in a vertical orientation comprised of a bottom component, a top component, and threaded-rod-and-coacting-cylinder combination connected therebetween. The bottom component includes a base with an outer upright and an inner upright which encompass a portion of the grade beam or similar part of the foundation. Additional securement by threaded clamps can be used to more securely position the clamp if desired. A pad for distributing load forces is spread on the upper surface of the base of the bottom component where it contacts the grade beam. The top component has a member with horizontal holes through which rods are inserted. These holes are aligned with predrilled holes in the mortar between the first row of bricks and the foundation so that the rods are inserted through the holes in the horizontal member and into the holes in the mortar. A first rod of the rod-and-cylinder combination extends upwardly from the bottom component and a second rod downwardly from the top component member, the first and second rods being reverse threaded with respect to each other. A threaded cylinder is then screwed between the two rods to control the height of the top component with respect to the bottom component. A second combination of rods and cylinder to that just described is located alongside the first combination to provide leveling in a second orthogonal direction.

4 Claims, 1 Drawing Sheet

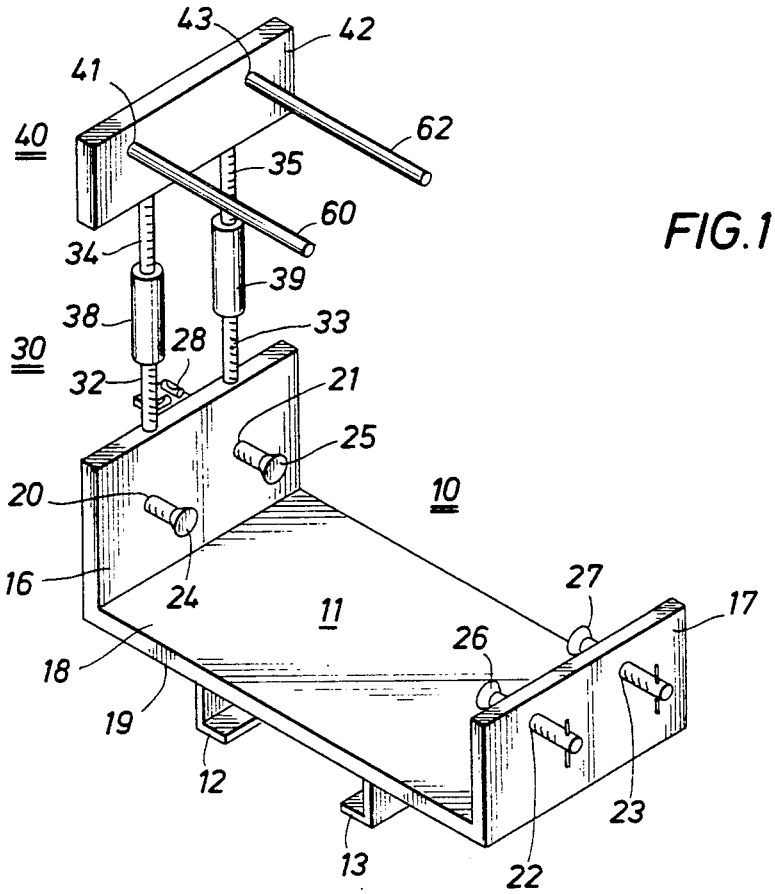
FIG.1
FIG.2
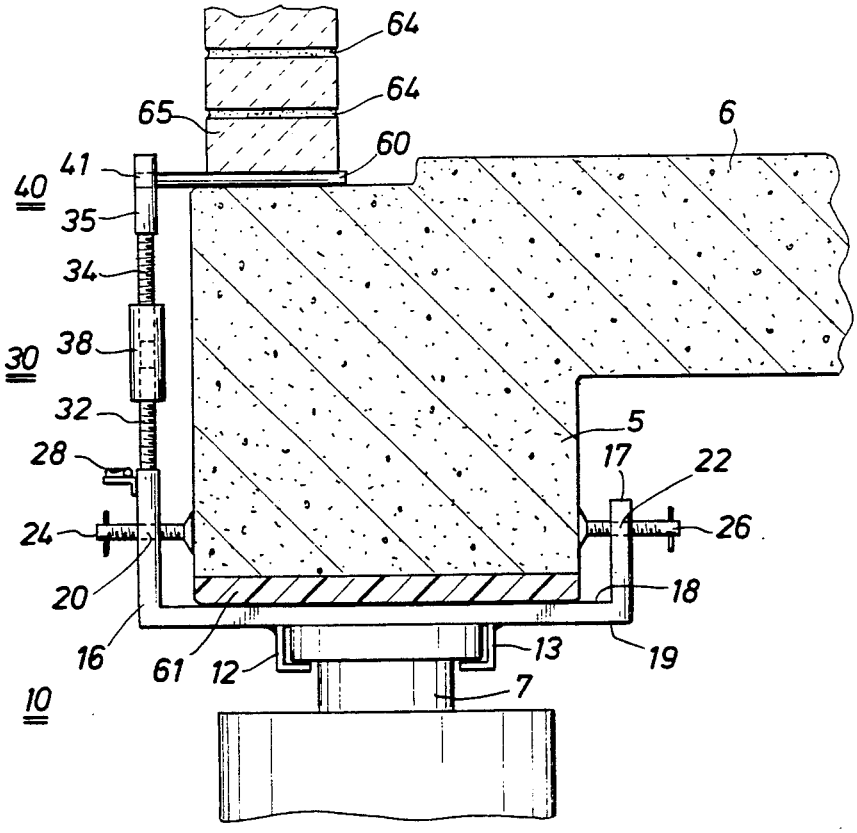

CLAMP FOR HANGING JACK

BACKGROUND OF INVENTION

1. Field of Invention

This invention pertains to building foundation renovation and more particularly to locating and positioning a jack used for installing pilings underneath a foundation for shoring purposes.

2. Description of the Prior Art

It is well known that many buildings and other structures are built on foundations that over time become unlevel for a variety of reasons and, therefore, require shoring. Also well known is the fact that existing foundations remain level to prevent foundation damage and damage to the structures built on them. So, in many instances, shoring of foundations is often performed to prevent potential damage from occurring or to minimize the effects of incipient damage, as well as to restore or repair faulty foundations to their original condition.

Foundation rehabilitation or restoration can be conducted using many different procedures. However, one of the most successful procedures involves excavating or partially excavating underneath the grade beams that need to be supported or raised, placing a piling section in the excavated cavity underneath the grade beam, placing a construction jack between the grade beam and the piling section, and then operating such jack by hydraulic or pneumatic action to force the piling section downward into the ground while supporting the grade beam. Once the piling section is driven sufficiently into the ground so that its top is flush with the bottom of the excavated area, then another piling section is put in place on top of the previous piling section and the jack is reactivated.

Eventually, either the piling made up of the piling sections will either hit bedrock or the ground underneath and surrounding the piling will become so compacted as to make further piling section additions unnecessary. Of course, once the piling is sufficiently firm and stable, then it is possible to reverse the jack driving action to raise the grade beam, if necessary.

In the procedure just described, it is crucial that the piling sections be driven into the ground in a vertical manner. A foundation supported by a non-vertical piling is not supported properly and may actually later shift or cause the piling to shift, which would result in potential damage that would not have occurred except for the nonvertically aligned piling. The piling sections are driven in vertically when guided by a vertically aligned jack; however, when the jack is not vertically aligned, then the piling sections are not driven in vertically.

When the jack is just placed next to the underneath surface of the grade beam, there is a real possibility that the jack will not be vertically aligned or remain vertically aligned during the pile driving operation. This is because the grade beam surface may not be horizontal or it may have sufficient imperfections in it that it will not provide a stable horizontal base or platform against which work can be performed. The driving of the piling results in vibrations and such vibrations can either cause the jack to move around on the surface of the grade beam or even result in some crumbling of the grade beam surface. Crumbling of the surface will, of course, raise further possibilities of the surface being other than level or horizontal with respect to the top surface of the jack. The prior art procedures employed shims to accomplish a horizontal platform. But, vibrations even cause shims to reposition and to become non-horizontal and sometimes even unstable.

Jacks, however, can be attached to the grade beam so as to prevent relative movement therebetween. However, clamping to a grade beam surface will not result in a vertically aligned jack when the surfaces of the grade beam against which clamping is performed are not horizontal or vertical to begin with. Further, when a metal jack is clamped adjacent a concrete surface, crumbling problems can still occur, as described above. Moreover, the procedure previously described involving driving of one piling section after another, requires the jack to be collapsed and relocated on top of each successive section. When a jack is installed too permanently with respect to the grade beam, it is very time consuming to disconnect and reinstall it using shims or the like to insure a level, horizontal structure each time in order to position another piling section preliminary to driving it in.

Therefore, a feature of the present invention is to provide an improved clamp for attaching to a grade beam or other foundation structure for holding a jack in a vertically aligned position, regardless of the level nature of the grade beam surfaces or any irregular contours or other conditions of such surfaces.

It is another feature of the present invention to provide an improved hanging jack clamp that can be positioned and held in at least a semi-permanent manner with some holding means providing leveling adjustment in multiple directions to assure vertical alignment of the jack regardless of the condition of the member to which the clamp is attached.

It is still another feature of the present invention to provide an improved hanging jack clamp with built-in level indicators and adjustment provisions to assure vertical alignment of the jack hanging therefrom at all times.

It is yet another feature of the present invention to provide an improved hanging jack clamp having provisions for assuring the vertical alignment of the hanging jack attached thereto, the connection or attachment provisions being of a quick-disconnect nature to permit rapid removal and reconnection of the hanging jack during its use without interfering with the level adjustments.

SUMMARY OF THE INVENTION

The current invention in its preferred embodiment is comprised of a top component, a bottom component, a vertical adjustment means, and a leveling means. The top component is further comprised of a horizontal member having a plurality of holes into which an equal number of horizontal rods are inserted. The bottom component has a horizontal base with two uprights that extend vertically upward. Each upright has a passageway through which threaded clamps are screwed or unscrewed to accommodate differing horizontal dimensions while securely fastening the bottom component to the foundation. The bottom component furthermore has on the underside of its base a pair of channel guides into which the edges of the jack's platform are inserted to secure the jack to the base. Other securement means can be provided, if desired. Adjustment means is comprised of a pair of rods threaded on a single end and controlled by a threaded cylinder. The first rod extends downwardly from the bottom of a top component's block member while the second rod extends upwardly from the outer upright of the bottom component. The opposite ends of the rods are then screwed into the threaded cylinder between the two rods to provide an adjustment that levels the horizontal base of the bottom component by vertically changing the net vertical dimension of a rod pair. Since there are two combinations, it is possible to level the base of the bottom component in two orthogonal directions with respect to the horizontal plane. Such levelling insures that the jack secured to the underneath side of the base hangs straight down or is vertically aligned.

The assembly also employs a pad above the horizontal base of the bottom component for cushioning purposes and to minimize the effects of surface imperfections on the underside of the grade beam.

BRIEF DESCRIPTION OF THE DRAWINGS

So that the manner of the above-recited features, advantages and objects of the invention, as well as others which will become apparent, are attained and can be understood in detail, a more particular description of the invention briefly summarized above may be had by reference to the exemplary preferred embodiment thereof illustrated in the drawings that form a part of this specification. It is nevertheless to be noted that the appended drawings illustrate only a typical preferred embodiment of the invention and are not to be considered limiting of its scope as the invention may admit to other equally effective embodiments. In the drawings:

FIG. 1 ia a perspective view of a preferred embodiment of the invention.

FIG. 2 is a side view of the structure shown in FIG. 1 as it is deployed on the foundation grade beam and with a suitable jack for driving in piling sections in a vertical direction.

DESCRIPTION OF THE PREFERRED EMBODIMENT

As mentioned in the prior art section above, the initial steps of a typical foundation repair procedure using the hanging jack clamp herein disclosed involve placing jacks, each employing a respective clamp under the foundation, that is, between the bottom of the foundation and the ground. Excavations are usually required underneath the foundation in order to insert the jacks between the foundation and the floor or bottom of the excavation and the jacks to insert a piling section. The height of a piling section varies, but generally is between one and three feet.

A number of jacks may be placed in series in a single excavation, all engaging via a respective suitable hanging jack clamp as hereinafter described, the bottom of a grade beam that, in turn, supports at least a portion of the remainder of the foundation and the structure built thereon. Each jack is used in setting a separate piling in the manner described above. Alternatively, a single hanging jack clamp and jack can be employed in some instances.

The hanging jack clamp basically is a device that wraps around a depending segment of a grade beam or other similar foundation structure, clamps thereto, and includes facility for quick-disconnect attachment of the hanging jack. Now referring to the drawings, it will be seen that the hanging jack clamp comprises bottom component 10, top component 40, and vertical adjustment means 30, as is illustrated in FIG. 1. Bottom component 10 provides horizontal stability for the hanging jack relative to grade beam 5 of foundation 6 and vertical stability relative to jack 7 (all as shown in FIG. 2). Top component 40 provides vertical stability relative to grade beam 5 when used in conjunction with vertical adjustment means 30 and bottom component 10. Vertical adjustment means 30 controls the height of top component 40 relative to bottom component 10 to enable the invention to be practiced with grade beams or the like of varying vertical dimensions. The invention furthermore comprises a level indicator 28 affixed to any one of top component 40, adjustment means 30, or preferably bottom component 10 to indicate whether bottom component 10 is level regardless of whether the cushioning pad and the underneath surface of the grade beam are level. Level indicator 28 is comprised of two separate bubble gauges to indicate leveling in two orthogonal directions but may also comprise a single center gauge well known in the art.

Again referring to FIG. 1, bottom component 10 is further comprised of base 11 with upper horizontal surface 18 and lower horizontal surface 19 and having outer vertical upright 16 and inner vertical upright 17 extending upwardly from base 11. Base 11, upright 16, and upright 17 may all be features of a single molded or cast piece or may be separate pieces fastened together to form a single piece.

Channel guides 12 and 13 are affixed to lower surface 19 of base 11 to hold jack 7 snugly against surface 19 via the platform ledge or lip structure at the top of the jack. Such connection, which is similar to a tongue-and-groove connection, provides a means for quick-disconnect removal of the jack from the clamp and its replacement so that the top flat, horizontal surface of the jack is in snug contact with the flat, horizontal surface of pad 61 located against the underneath surface of the grade beam. In the preferred embodiment, upright 16 has a pair of transverse threaded passageways 20 and 21 through which threaded clamping means 24 and 25 are inserted. Upright 17 likewise has a pair of transverse passageways 22 and 23 through which threaded clamping means 26 and 27 are inserted.

Top component 40 is further comprised of an upright block member 42 having transverse, horizontal holes 41 and 43. Rods 60 and 62 are slip fit into holes 41 and 43, respectively. Adjustment means 30 is further comprised of threaded rods 32, 34 and 33, 35 and threaded cylinders 38 and 39. Rod 34 extends downwardly member from 40 and is screwed into a first end of threaded cylinder 38. Rod 32 extends upwardly from upright 16 and screws into the second end of threaded cylinder 38. Rod 33, rod 35 and cylinder 39 are assembled in like manner. Rods 32 and 34 are reverse threaded with respect to each other as are rods 33 and 35.

The hanging jack clamp is deployed as is shown in FIG. 2. Pad 61, which absorbs and distributes the load during the driving operation, is first spread across surface 18. Pad 61 helps prevent development of point loads that would otherwise damage grade beam 5 over time. Uprights 16 and 17 are spaced sufficiently apart to encompass the width of grade beam 5 and threaded clamps 20–23 are tightened against grade beam 5 to provide additional horizontal stability.

Adjustment means 30 controls the height of top component 40 relative to bottom component 10 by adjustment of its various components so that rods 60 and 63 are at the level of mortar 64 between the first row of bricks 65 and grade beam 5, where, it may be seen, rods 60 and 63 are inserted through holes previously drilled in mortar 64. Rods 60 and 63 are consequently inserted through both holes 41 and 43 and the holes in mortar 64 to provide vertical stability for the invention relative to grade beam 5 regardless of the condition of the surfaces of the grade beam that otherwise would require clamping attachment. Such structure of the clamp ensures that jack 7 can be adjusted to hang vertically straight down regardless of the condition or slant to the underneath side of the grade beam itself or the fact that holes 41 and 43 and the holes in which rods 60 and 62 are inserted are not in perfect horizontal alignment. The actual adjustment is with respect to the combined lengths of vertical rods 32 and 34 and of vertical rods 33 and 35 to ultimately level or make horizontal base 11 of bottom component 10. When base 11 is level, then jack 7 hanging or depending from the channel guides is made to be vertical.

While a preferred embodiment of the invention has been shown, it will be understood that the invention is not limited thereto. Implications of equivalent alternate structures and procedures will become apparent to those skilled in the art. For instance, bottom component 10 could be employed without the aid of top component 40 or vertical adjustment means 30. Such a configuration is not the preferred embodiment since it would sacrifice vertical stability although it would maintain horizontal stability. Alternatively, bottom component 10 could be deployed without the use of threaded clamps 24–27 although this embodiment would sacrifice some horizontal stability while maintaining vertical stability relative to grade beam 5 for jack 7. It therefore follows that bottom component 10 can be deployed with any number of threaded clamps to obtain horizontal stability proportional to the number of such clamps. Also, vertical adjustment means 30 could be comprised of a single rod and cylinder combination, i.e., rod 34, cylinder 38 and rod 32 but not rod 35, cylinder 39, and rod 33, albeit with some sacrifice in structural strength. The vertical adjustment means can be comprised of more than two rod and cylinder combinations and more than two rods may be used in conjunction with the top component. Similarly, only one of rods 41 and 43 would suffice. Also, the means for attaching the hanging jack to the underneath side of the horizontal base of the bottom component can be other than via channel guides, if desired. Still other modifications and alternative embodiments may become apparent to those skilled in the art.

What is claimed is:

1. Hanging jack clamp for vertically attaching a jack to a foundation member, comprising:
- a bottom component, comprising
  - a base having an upper horizontal surface and a lower horizontal surface,
  - jack holding means on the lower horizontal surface for hangingly receiving and securing the jack,
  - an outer upright connected to an end of said base, and
  - an inner upright connected to the opposite end of said base;
- a top component, comprising
  - a vertical member having a transverse passageway therethrough, and
  - a horizontal rod inserted through said transverse passageway,
- vertical adjustment means for clampingly adjusting said base of said bottom component with respect to said top component, comprising
  - a first threaded rod extending upwardly from said outer upright of said bottom component,
  - a second threaded rod extending downwardly from said vertical member of said top component, and
  - a threaded cylinder connecting said first threaded rod;
- a level affixed to at least one of said bottom component, said top component, and said vertical adjustment means; and
- a pad spread across said upper horizontal surface of said base of said bottom component.

2. Hanging jack clamp in accordance with claim 1, wherein the outer upright has a first threaded transverse passageway therethrough and a threaded clamping means inserted through the first threaded transverse passageway.

3. Hanging jack clamp in accordance with claim 1 or claim 2, wherein the inner upright has a second threaded transverse passageway and a second threaded clamping means inserted through the second threaded transverse passageway.

4. Hanging jack clamp for vertically attaching a jack to a foundation member, comprising:
- a bottom component, comprising
  - a base having an upper horizontal surface and a lower horizontal surface,
  - a pair of channel guides on the lower horizontal surface for hangingly receiving the jack,
  - an outer upright connected to an end of said base having a first pair of transverse threaded passageways therethrough,
  - an inner upright connected to the opposite end of said base having a second pair of transverse threaded passageways therethrough,
  - a first pair of threaded clamping means inserted through said first pair of transverse threaded passageways, and
  - a second pair of threaded clamping means inserted through said second pair of transverse threaded passageways of the inner upright of said bottom component;
- a top component, comprising
  - a vertical member having a third pair of transverse passageways therethrough, and
  - a pair of horizontal rods respectively inserted through said third pair of transverse passageways;
- vertical adjustment means for clamping adjusting said base of said bottom component with respect to said top component, comprising
  - a first pair of threaded rods extending upwardly from said outer upright of said bottom component,
  - a second pair of threaded rods extending downwardly from said top component,
  - a pair of threaded cylinders, one of said cylinders connecting one of said first pair of threaded rods to the corresponding one of said second pair of threaded rods and the other one of said cylinders connecting the other one of said first pair of threaded rods to the corresponding other one of said second pair of threaded rods;
- a level affixed to at least one of said bottom component, said top component, and said vertical adjustment means; and
- a pad spread across said upper horizontal surface of said base of said bottom component.

* * * * *